United States Patent [19]

Fishman

[11] 4,356,754

[45] Nov. 2, 1982

[54] MUSICAL INSTRUMENT TRANSDUCER

[76] Inventor: Lawrence R. Fishman, 76 Grove St., West Medford, Mass. 02155

[21] Appl. No.: 198,939

[22] Filed: Oct. 20, 1980

[51] Int. Cl.[3] ..... G10H 3/00

[52] U.S. Cl. ..... 84/1.16; 84/DIG. 24; 84/1.14

[58] Field of Search ..... 84/1.16, 1.14, DIG. 24, 84/1.15

[56] References Cited

U.S. PATENT DOCUMENTS

| | | | |
|---|---|---|---|
| 2,222,057 | 11/1940 | Benioff | 84/DIG. 24 |
| 3,291,887 | 12/1966 | Carman et al. | 84/DIG. 24 |
| 3,453,920 | 7/1969 | Scherer | 84/DIG. 24 |
| 4,147,084 | 4/1979 | Underwood | 84/DIG. 24 |
| 4,228,715 | 10/1980 | Nourney | 84/1.16 |

FOREIGN PATENT DOCUMENTS

| | | | |
|---|---|---|---|
| 1542894 | 3/1979 | United Kingdom | 84/DIG. 24 |

*Primary Examiner*—J. V. Truhe
*Assistant Examiner*—Forester W. Isen
*Attorney, Agent, or Firm*—Wolf, Greenfield & Sacks

[57] ABSTRACT

A plurality of vibration transducers are mounted on the face of the bridge of a stringed musical instrument, particularly as disclosed herein in connection with a bass violin. The transducers are adapted for mounting without modification to the instrument, preferably with the use of a mounting clip for each transducer. The transducers are preferably of wafer size and shape and are disposed for sensing vibrations at a location on the bridge that is optimum for both the production of a high fidelity output signal and the discouragement of acoustical feedback.

16 Claims, 4 Drawing Figures

MUSICAL INSTRUMENT TRANSDUCER

BACKGROUND OF THE INVENTION

The present invention relates in general to transducers for musical instruments and pertains, more particularly, to a bridge mounted transducer array for a stringed instrument such as a bass violin.

The bass violin, when played in a popular or jazz group is plucked rather than bowed. In this mode of operation the instrument is rather soft in volume and must be electronically amplified. Simply placing a microphone in front of the instrument on a stage is generally not satisfactory because the microphone tends to pick up other sounds on the stage (drums, etc.). In addition, when the microphone is turned up high enough to pick up the sounds of this quiet instrument, the microphone is very prone to acoustical feedback or squealing.

A more successful approach to this amplification problem has been to place a vibration sensitive transducer directly on the instrument itself. This type of pick-up senses the vibrations on the instrument body only, and is not affected by the ambient vibrations. This style of pick-up is commonly referred to as a contact pick-up. The contact pick-ups generally available are usually a plug of piezoceramic material encased in epoxy or plastic to protect the fragile crystal. This piezoceramic crystal has the piezoelectric property of emitting a d.c. voltage when deformed. When mounted on the instrument (usually with tape or putty) the vibrations of the instrument bend the crystal which, in turn, emits an electrical analog of the mechanical vibration. This electrical signal can then be amplified and used to drive loudspeakers.

Although the contact type pick-up is an improvement over the microphone, it still has inherent problems. The placement on the instrument is critical so as to provide an even response from each string. At high volumes, when the pick-up is improperly located, it causes the entire instrument to become microphonic and thus create a feed-back similar to the type of feed-back experienced with a stage microphone. Most of the transducers available have been unsuccessful in properly reproducing the characteristic sound of the instrument. Their inability to do so generally arises from improper location on the instrument and associated mounting technique which is often responsible for the less than optimum sensing location of the transducer. An example of a commonly used, but rather undesirable method of mounting is securing the transducer element to the vibratile member with a layer of wax or putty. However, it has been found that the mechanical coupling provided by these compressible materials is too resilient to accurately transfer the vibrations from the instrument body to the transducer.

In accordance with the invention it has been found that as far as the location of the transducers is concerned, the bridge rather than the body of the instrument is preferred due to the improved transient response that is available when the transducers are mounted physically close to the initial vibration producer (the string). The general objective is to provide the characteristic acoustic sound. In accordance with the invention it is an object to determine the best location to capture this sound at the same time eliminating feedback. In accordance with the invention the transducer element and its associated mounting are designed to operate in this optimized location. In this connection experiments have been made to better define the different types of vibrations that are present on the bridge to ascertain a proper location. A full scale drawing of the bridge is made on one-quarter inch square grid paper. A point source piezoelectric transducer one-quarter inch by one-quarter inch is used. This point source transducer is placed at various points on the bridge and the instrument is then played. The location is then noted on the grid and the sound is graded by the player with regard to the following criteria:

1. Pure string tone (sinusoidal).
2. Transient response—attack.
3. Nodally enhanced tone.
4. Feedback resistance.

One may define particular areas on the bridge and analyze them. In this regard reference can now be made to FIG. 3 wherein areas A, B, C and D are defined. Area A provides a pure sound strongest in pure sinusoidal string tone with good transient response and high feedback resistance. Area B is a transition area that is mostly pure but has some nodal presence with good feedback resistance and good attack. Area C which lies generally below areas A and B is highly nodal, very unstable, has little pure sound, has poor attack and a high feedback. Area D which essentially surrounds each string has the best attack.

The characteristic acoustic sound of the instrument is generally determined by the manner in which the resonator enhances and modifies the pure tone produced by the vibrating string. Thus, it is desired to have a pick-up that can sense both pure string vibrations and enhanced vibrations. In other words it is desirable to have a pick-up that can sense various degrees of the pure tone and enhanced areas in addition to the impulse and low frequency areas. In accordance with the present invention it has been found that a pair of transducers is generally preferred over the use of four separate transducers. In this regard, one transducer and element senses the impulse areas of the g and d strings while the other transducer senses the impulses of the a and e strings. In addition, each of the transducers is preferably arranged to cover area b referred to hereinbefore, the transition area.

Another feature in accordance with the present invention is the adjustability of the transducer arrangement. In some instruments, one string may be often found to be less responsive than the other strings. This imbalance can be adjusted in accordance with the present arrangement by sensing more of that string's impulse area. Thus, the pick-ups can be easily moved to adjust the sensing. Also, the pick-ups can be easily moved up or down to sense different proportions of pure or enhanced sound. The overall sound can be adjusted to the taste of the performer without the necessity of elaborate signal equipment at the amplifier end.

Also, in accordance with the invention it has been found that the transducer element is preferably extremely compliant so as to accurately discriminate the individual areas it covers. A wafer thin piezoelectric crystal used alone is generally too fragile. Thus, in accordance with the invention there is provided a combination of crystal laminated to a soft metal such as brass. With this arrangement, tracking has been found to be excellent and the transducer is also quite durable. In accordance with the invention attachment via a felt padded brass clip provides easy mounting, adjustability, and added protection to the crystal.

Existing bridge-mounted devices generally operate in an area on the instrument which is far less than optimum. For example, the typical putty-mounted transducers, because of their poor tracking ability, only operate in areas of large magnitude vibrations. These areas only exist in the undamped sections of the bridge which are full of undesirable harmonics. Another example of a device presently used is a transducer that is wedged into wing-slots on the bridge. These devices track better than the putty mounted transducers but still sense harmonics present in the wings. They also suffer from a frequency-doubling effect which tends to produce first octave rather than fundamental emphasis. This effect is not true to the characteristic acoustic sound. See for example the Underwood U.S. Pat. No. 4,147,084.

Accordingly, one object of the present invention is to provide a bridge mounted pick-up that is readily mounted in a highly damped, node-free area of the bridge and that is sufficiently sensitive to accurately produce an analog of the vibrations of the mounting area.

Another object of the present invention is to provide a pick-up that is readily mounted to the stringed instrument without modification of the instrument.

Still another object of the present invention is to provide an improved transducer design that is extremely feedback resistant even at very high volume.

A further object of the present invention is to provide an improved means of mounting a transducer in association with a stringed musical instrument. In accordance with this object, the transducer or transducers are mounted close to the string to provide a short transient response resulting in improved "attack" and more "presence".

Still a further object of the present invention is to provide an improved transducer design and associated means for mounting associated with a stringed musical instrument and characterized by a greater fundamental pitch definition. This improved definition results by placing the transducers at the point of optimum damping. At other locations the elements tend to artificially emphasize nodes which are often present.

SUMMARY OF THE INVENTION

To accomplish the foregoing and other objects of this invention, there is provided preferably a pair of very sensitive, highly compliant, piezoelectric transducers which are held in compression by felt-padded clips preferably of brass. These clips hold the transducers against a highly damped area of the bridge in the vicinity of the area wherein the strings pass over the bridge. In the disclosed embodiment the transducer system is shown in connection with a bass violin, however, it is understood that the transducer system concepts may also be applied to other stringed musical instruments. With such an arrangement the resultant electrical signal is an accurate analog of the characteristic acoustic sound of the instrument. In a four-stringed instrument there are preferably employed two transducers each having their respective adjustable padded clip adapted to be slipped over the edge of the bridge and for tightly squeezing the transducer wafers against the bridge face just below the string contact point. In one embodiment, with the use of two transducers one transducer sensed vibrations from the g and d strings while the other sensed the vibrations from the a and e strings. A common cable carries the signal wires from the transducers to a plug connector that is mounted adjacent the tailpiece of the instrument.

BRIEF DESCRIPTION OF THE DRAWINGS

Numerous objects, features and advantages of the invention should now become apparent upon a reading of the following detailed description taken in conjunction with the accompanying drawing in which.

DETAILED DESCRIPTION

Figure 1:
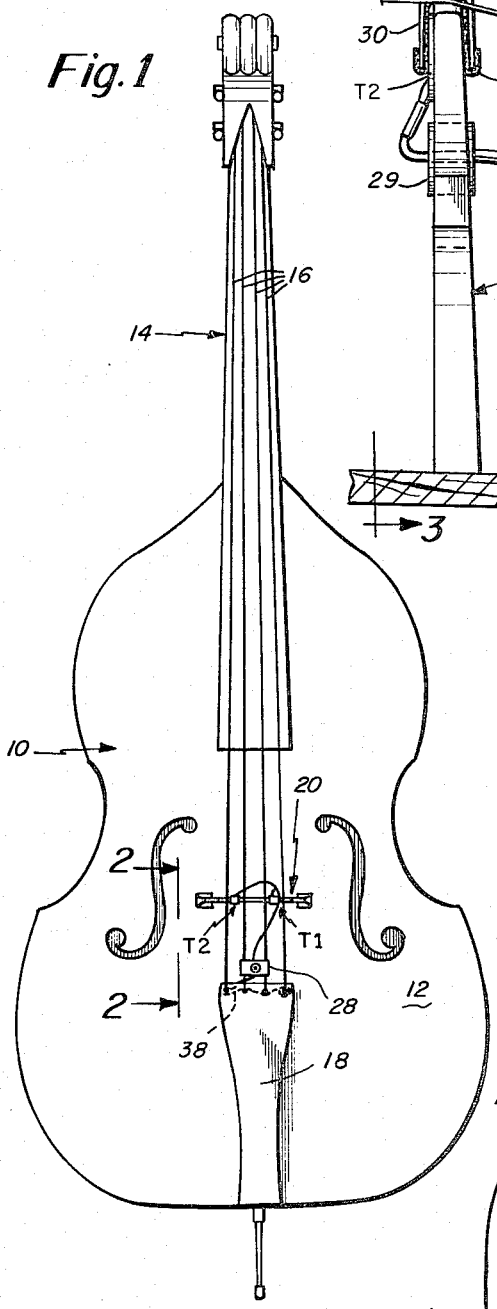
FIG. 1 is a plan view of a stringed musical instrument, particularly a bass violin, showing the transducer system of this invention used therewith.

Referring now to the drawing, there is shown a stringed musical instrument in the form of a bass violin 10 which comprises a body 12 and associated neck 14. There are also a plurality of strings 16 which in the embodiment described include four strings identified herein from a musical standpoint as strings e, a, d and g. At the neck end of the instrument the strings are supported in a conventional manner such as by the use of support keys or the like. The strings may also pass over a nut and along the fingerboard of the neck. At the body end of the strings, they are supported, again, in a conventional manner at the tailpiece 18. The strings, of course, also pass over and are supported and spaced by the bridge 20. The bridge that is depicted in the drawing may also be of conventional design. One of the distinct advantages of the system of this invention is that the entire instrument may be maintained without essentially any alterations thereto in adapting the transducers.

Figure 4:
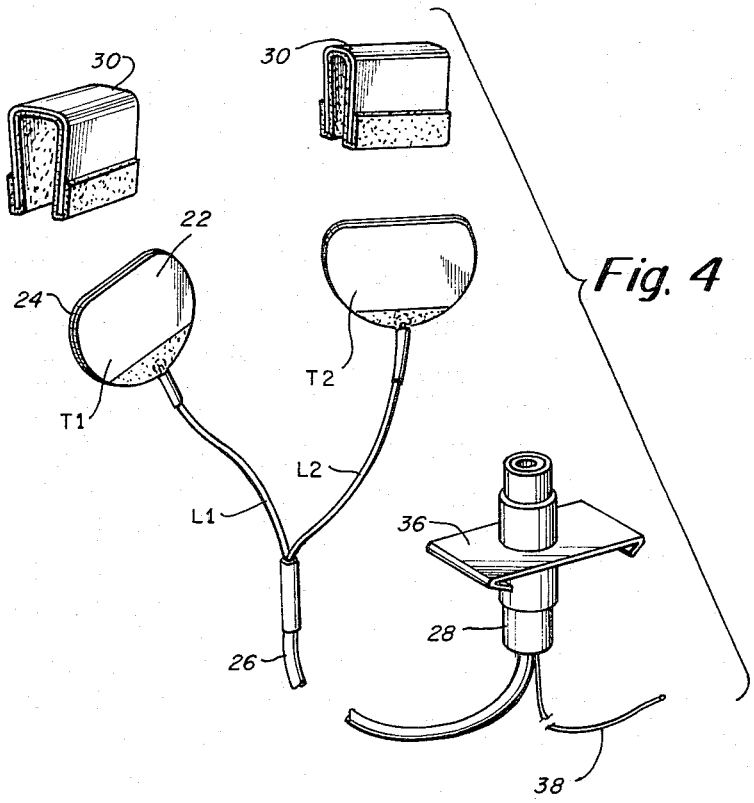
FIG. 4 is a perspective view showing the transducer construction, and associated mounting.

As mentioned previously, the technique of applying transducers by putty or the like has proven to be unsatisfactory. This manner of mounting did not allow for accurate tracking. Furthermore, if the transducers are encased in epoxy or plastic, this was not sufficiently compliant to sense the vibration. Thus, in accordance with the present invention there is provided a more compliant element preferably employing a piezoceramic wafer that may be 0.010 inch thick and which is preferably laminated to a brass plate also that may be 0.010 inch thick. FIG. 4 depicts the piezoceramic wafer 22 and associated plate substrate preferably of brass 24. The drawing also shows transducers T1 and T2 coupling by way of respective leads L1 and L2 to the common signal wire cable 26. This cable 26 carries both leads to the plug connector 28. Both of the leads L1 and L2 are, of course, of insulated coaxial cable. Both of these leads may be connected in common to a single output connector or a pair of connectors could be used for keeping the transducer signal separated at the instrument to add even a greater degree of adjustment.

In accordance with the present invention there is also provided an improved method of mounting the transducers T1 and T2. This includes an adjustable (by bending) brass clip 30 that is generally of U-shape having at its ends felt pads 32. The mounting clip 30 is adapted to be slipped over the top edge 21 of the bridge 20. The clip and in particular its felt pads 32 tightly squeeze the wafer-like transducer against the bridge face 23 just below the points at which the strings contact the bridge. The clip holds the brass plate 24 against the bridge face 23. In the particular embodiment described herein, wherein there are four strings used, then two transducers T1 and T2 are employed. One of these transducers senses vibrations from the g and d strings, while the other transducer senses the vibrations from the a and e strings.

Figure 2:
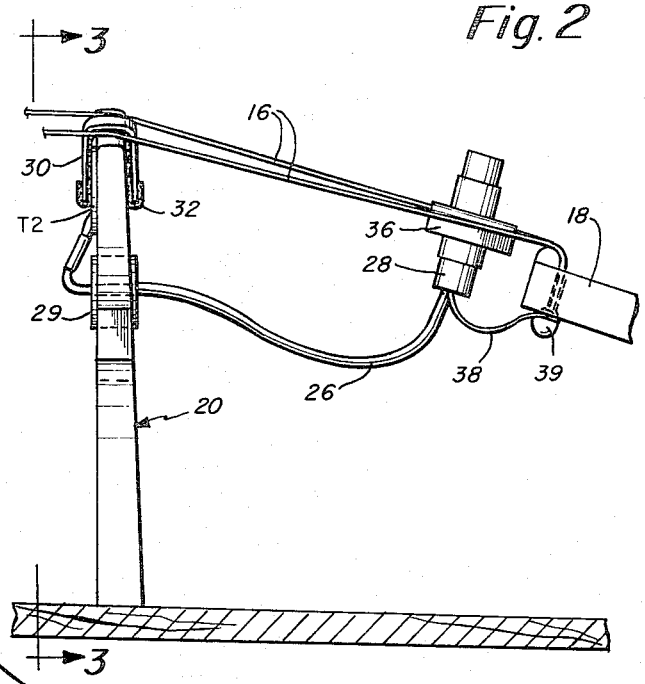
FIG. 2 is a side elevation view as taken along lines 2—2 of FIG. 1.

The plug connector 28 may be a conventional RCA style plug mounted by means of plate 36 which is adapted at its ends to extend about two adjacent strings. The connector 28 may be secured to the securing plate 36 in a normal manner. FIG. 2 also shows the ground lead 38 extending to the tailpiece from the connector 28.

As indicated in the drawing, the transducers are mounted on the side of the bridge which faces upward when the bass violin is held in a playing position. In accordance with the technique of applying this transducer system, one of the transducers is centered between the g and d strings with its flat edge preferably about ⅛ inch below the upper edge 21 of the bridge. The brass clip is then slid over the transducer to secure it. The clip should be tightly pushed against the bridge edge 21 and may be adjusted by bending the clip so as to firmly squeeze the transducer against the bridge face. A similar operation is performed with regard to the other transducer centered between the a and e strings as depicted in, for example, FIG. 3. The cable 26 is preferably run through a rubber isolation plug 29 shown in FIGS. 2 and 3 in the wing hole in the bridge. This prevents the cable from vibrating against the bridge. The securing plate 36 is shown clipped over the a and d strings adjacent to the tailpiece 18.

As previously indicated, there is also a ground wire 38. If this ground wire is not used, the strings function as antenna and induce rf or other electromagnetic interference into the pick-up element. Thus, the ground lead is preferably always employed. This ground lead is simply weaved between the string-ball ends making sure that it contacts each of the balls 39. At the transducer the other end of the ground wire is connected to the brass substrate.

Figure 3:
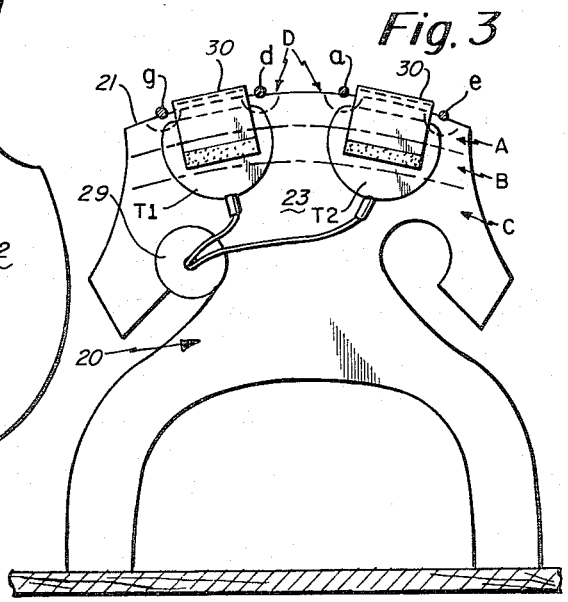
FIG. 3 is an end view as taken along lines 3—3 of FIG. 2.

In FIG. 3 it is noted that areas a, b, c and d have been defined. The width of the areas a and b is both approximately ¼ inch. As previously indicated, the top flat edge of the transducer is preferably about ⅛ inch from the bridge edge 21. Also, the mid-point of the transducer is preferably aligned with the mid-point of area b. The height of the transducer shown in FIG. 3 is approximately ¾ of an inch. The mid-point of the area b is approximately ⅜ of an inch from the edge 21. In this regard it is preferred that the top of the transducer be flat as indicated in FIG. 3.

Having described one embodiment of the present invention, it is apparent that numerous other embodiments are contemplated as falling within the scope of this invention. For one thing the conetps of this invention may be applied to other types of stringed musical instruments and in particular those employing a bridge or the like for any type of string support.

What is claimed is:

1. For a stringed musical instrument having a bridge or the like adapted to support and space the strings, said bridge having oppositely directed, substantially parallel, front and rear bridge faces extending substantially transverse to the longitudinal axis of the instrument, apparatus for sensing the vibrations of the strings comprising vibration sensitive transducer means, means for mounting said transducer means on the bridge in intimate contact with at least one of the front and rear faces of the bridge and in close proximity to the strings, electrical lead means coupling from said transducer means, and an electrical connector coupling to said lead, and wherein said bridge has a top edge and said mounting means for said transducer means comprises a mounting member adapted to extend over the top edge of the bridge for holding said transducer means against the face of the bridge.

2. Apparatus as set forth in claim 1 wherein said vibration sensitive transducer means comprises a pair of transducers.

3. Apparatus as set forth in claim 2 in combination with an instrument having four strings with one of said transducers associated with one pair of strings and the other of said transducers associated with the other pair of strings.

4. Apparatus as set forth in claim 3 wherein both transducers are piezoelectric transducers.

5. Apparatus as set forth in claim 1 wherein said transducer means is a piezoelectric transducer.

6. Apparatus as set forth in claim 1 wherein said mounting member comprises a mounting clip.

7. Apparatus as set forth in claim 6 wherein said mounting clip has felt pads for contact with said transducer means.

8. Apparatus as set forth in claim 1 including means for supporting the connector from said strings adjacent the tailpiece and between the tailpiece and bridge.

9. Apparatus as set forth in claim 1 in combination with a musical instrument which has a tailpiece and strings and said electrical connector is positioned in the vicinity of the tailpiece.

10. Apparatus as set forth in claim 9 including a mounting plate for mounting the electrical connector between adjacent strings and adjacent the tailpiece.

11. Apparatus as set forth in claim 10 wherein the mounting plate has side grooves for receiving strings.

12. Apparatus as set forth in claim 1 wherein said transducer means is thin on the order of 0.020 inch thick.

13. Apparatus as set forth in claim 1 in combination with a musical instrument having a body and strings wherein said transducer means is positioned closer to the strings than to the instrument body.

14. Apparatus as set forth in claim 1 in combination with a musical instrument having a bridge wherein said transducer means has a top edge, said transducer means top edge spaced from said bridge top edge by on the order of ⅛ inch.

15. Apparatus as set forth in claim 1 wherein said transducer means has a thickness at least an order of magnitude less than the width of said transducer means bridge face.

16. For a stringed musical instrument having a bridge or the like adapted to support and space the strings, said bridge having oppositely directed, substantially parallel, front and rear bridge faces extending substantially transverse to the longitudinal axis of the instrument, apparatus for sensing the vibrations of the strings, comprising vibration sensitive transducer means, means for mounting said transducer means on the bridge in intimate contact with at least one of the front and rear faces of the bridge and in close proximity to the strings, electrical lead means coupling from said transducer means, an electrical connector coupling to said lead means, and means for supporting the connector from said strings adjacent the tailpiece between the tailpiece and bridge.

* * * * *